US007695122B2

(12) United States Patent
Umeda

(10) Patent No.: US 7,695,122 B2
(45) Date of Patent: Apr. 13, 2010

(54) INK FEEDING APPARATUS AND INK JET RECORDING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 797 days.

(21) Appl. No.: 11/434,848

(22) Filed: May 17, 2006

(65) Prior Publication Data

US 2006/0262169 A1 Nov. 23, 2006

(30) Foreign Application Priority Data

May 17, 2005 (JP) ..... 2005-143485

(51) Int. Cl.
*B41J 2/175* (2006.01)

(52) U.S. Cl. ..... 347/85

(58) Field of Classification Search ..... 347/7, 347/84, 85; 73/864.34, 864.35; 417/472, 417/473; 604/141

See application file for complete search history.

(56) References Cited

U.S. PATENT DOCUMENTS 4,623,905 A * 11/1986 Ichihashi et al. ..... 347/86
4,634,430 A * 1/1987 Polaschegg ..... 604/141
4,858,478 A * 8/1989 Kush et al. ..... 73/864.35
5,485,187 A * 1/1996 Okamura et al. ..... 347/85
6,224,198 B1 * 5/2001 Cook et al. ..... 347/85
6,375,293 B1 * 4/2002 Endo ..... 347/2
6,786,589 B2 * 9/2004 Suzuki et al. ..... 347/102
7,240,999 B2 * 7/2007 Kumagai et al. ..... 347/85

FOREIGN PATENT DOCUMENTS

| | | |
|---|---|---|
| EP | 1360995 | 11/2003 |
| JP | H6 8473 | 1/1994 |
| JP | 2002 339875 | 11/2002 |
| JP | 2005 7720 | 1/2005 |

* cited by examiner

*Primary Examiner*—Anh T. N. Vo
(74) *Attorney, Agent, or Firm*—Baker Botts L.L.P.

(57) ABSTRACT

An ink feeding apparatus including an ink tube enabling ink to flow between an ink tank and an image recording unit, and an ink feeding mechanism having a bellows pump interposed in the ink tube. The bellows pump includes a bellows body whose internal volume changes by expanding and contracting in a substantially vertical direction, and a connection port provided above the bellows body to connect the bellows body and the ink tube. An angle a formed upward by an upper surface inside a ridge fold portion of the bellows body with respect to a substantially horizontal direction and an angle b formed downward by an lower surface inside a ridge fold portion with respect to a substantially horizontal direction are related as $0° \leqq$ angle b<angle a<90°. Therefore, bubbles in the bellows pump are discharged swiftly and reliably.

10 Claims, 10 Drawing Sheets

INK FEEDING APPARATUS AND INK JET RECORDING APPARATUS

CROSS-REFERENCE TO RELATED APPLICATIONS

This Nonprovisional application claims priority under 35 U.S.C. §119(a) on Patent Application No. 2005-143485 filed in Japan on May 17, 2005, the entire contents of which are hereby incorporated by reference.

BACKGROUND OF THE INVENTION

1. Field of the Invention

The present invention relates to an ink feeding apparatus for feeding ink supplied from an ink tank through an ink path to an ink jet recording head, and in particular, relates to an ink feeding apparatus using a bellows pump as an ink feeding mechanism. The present invention also relates to an ink jet recording apparatus building in such an ink feeding apparatus.

2. Description of Related Art

Conventionally, an image recording apparatus of a so-called ink jet type has been known, that records images on a recording paper by allowing ink droplets to jet from a recording head and impact on the recording paper. In such an ink jet recording apparatus, a configuration in which ink is supplied to the recording head from an ink tank for storing ink through a predetermined ink path, is adopted.

In such conventional ink jet recording apparatus, however, there is a problem of bubbles generated in the ink path in an ink supply path. Bubbles are generated by various cause. For example, there may be such a case where gas dissolved in ink appears as bubbles due to change of temperature, or exterior air reaches the ink path by penetrating an ink tube or the like. In any case, bubbles generated in the ink path will lead to poor ink jetting from the recording head.

In a conventional ink jet recording apparatus as described above, an invention has been proposed, which makes possible to remove bubbles generated in the ink path together with ink by a sucking operation called purge or the like (See, for example, Japanese Patent Application Laid-Open No. H06-8473 (1996)). Also, a technology of removing bubbles in the ink path while jetting ink from the recording head by driving a pump provided in the ink path, has been proposed.

In the aforementioned conventional technology, a bellows pump has been known as a pump to be provided in the ink path. The bellows pump generates pumping pressure by deforming a bellows-shaped tubular body to expand and contract. Even in such a bellows pump, bubbles may be generated in ink resulting from change of temperature or the like. When bubbles should grow making such generated bubbles a core thereof, ink flows in the ink path may be blocked, or poor ink jetting may be caused by bubbles reaching the recording head. Therefore, in the bellows pump, it is desirable that bubbles are not generated, and even if bubbles are generated, it is desirable that they are removed before growing larger.

BRIEF SUMMARY OF THE INVENTION

The present invention has been made in view of the aforementioned problems. An main object of the present invention is to provide an ink feeding apparatus and an ink jet recording apparatus capable of swiftly and reliably discharging bubbles in a bellows pump provided in an ink path flowing ink from an ink tank to an ink jet recording head.

An ink feeding apparatus according to the present invention is characterized by comprising: an ink tank in which ink is stored; an image recording unit including an ink jet recording head for jetting the ink supplied from the ink tank as ink droplets; an ink path enabling the ink to flow between the ink tank and the image recording unit; and an ink feeding mechanism including a bellows pump connected midway of the ink path to make the ink flow; wherein the bellows pump includes: a bellows body whose internal volume changes by expanding and contracting in an upward and downward direction; and a connection portion provided above the bellows body to connect the bellows body and the ink path; and an angle a formed upward by an upper surface from a bend corner inside a ridge fold portion of the bellows body with respect to a direction perpendicular to the direction in which the bellows body expands and contracts and an angle b formed downward by a lower surface from the bent corner inside the ridge fold portion with respect to a direction perpendicular to the direction in which the bellows body expands and contracts are related as $0° \leqq \text{angle b} < \text{angle a} < 90°$.

Ink is fed from the ink tank to the ink jet recording head through the ink path. When bubbles are generated in the ink path, the ink feeding mechanism feeds ink in the ink path, so that the bubbles are discharged together with ink from the ink jet recording head. The bellows pump is used as a pump in the ink feeding mechanism. The bellows body of the bellows pump is arranged to expand and contract in the upward and downward direction (substantially vertically) in a state where the apparatus is placed on a horizontal surface, and the connection portion connecting the ink path and bellows body is provided above the bellows body. An angle a formed by an upper surface from a bend corner inside the ridge fold portion of the bellows body with respect to a horizontal direction and an angle b formed by a lower surface from the bend corner inside the ridge fold portion with respect to a horizontal direction have the relation of $0° \leqq \text{angle b} < \text{angle a} < 90°$. That is, the angle a of the upper inclined plane inside of the ridge fold portion is made to be larger than the angle b of the lower inclined plane. This makes, when bubbles are generated in the internal space of the bellows body, particularly in the ridge fold portion, the bubbles more likely to rise along the upper inclined plane and thus to be discharged from the bellows body to the ink path through the connection.

An ink jet recording apparatus according to the present invention is characterized by being provided with an ink feeding apparatus as described above.

The above and further objects and features of the invention will more fully be apparent from the following detailed description with accompanying drawings.

DETAILED DESCRIPTION OF THE PRESENT INVENTION

Hereinafter the present invention is described with reference to drawings showing embodiments thereof when appropriate.

Figure 1:
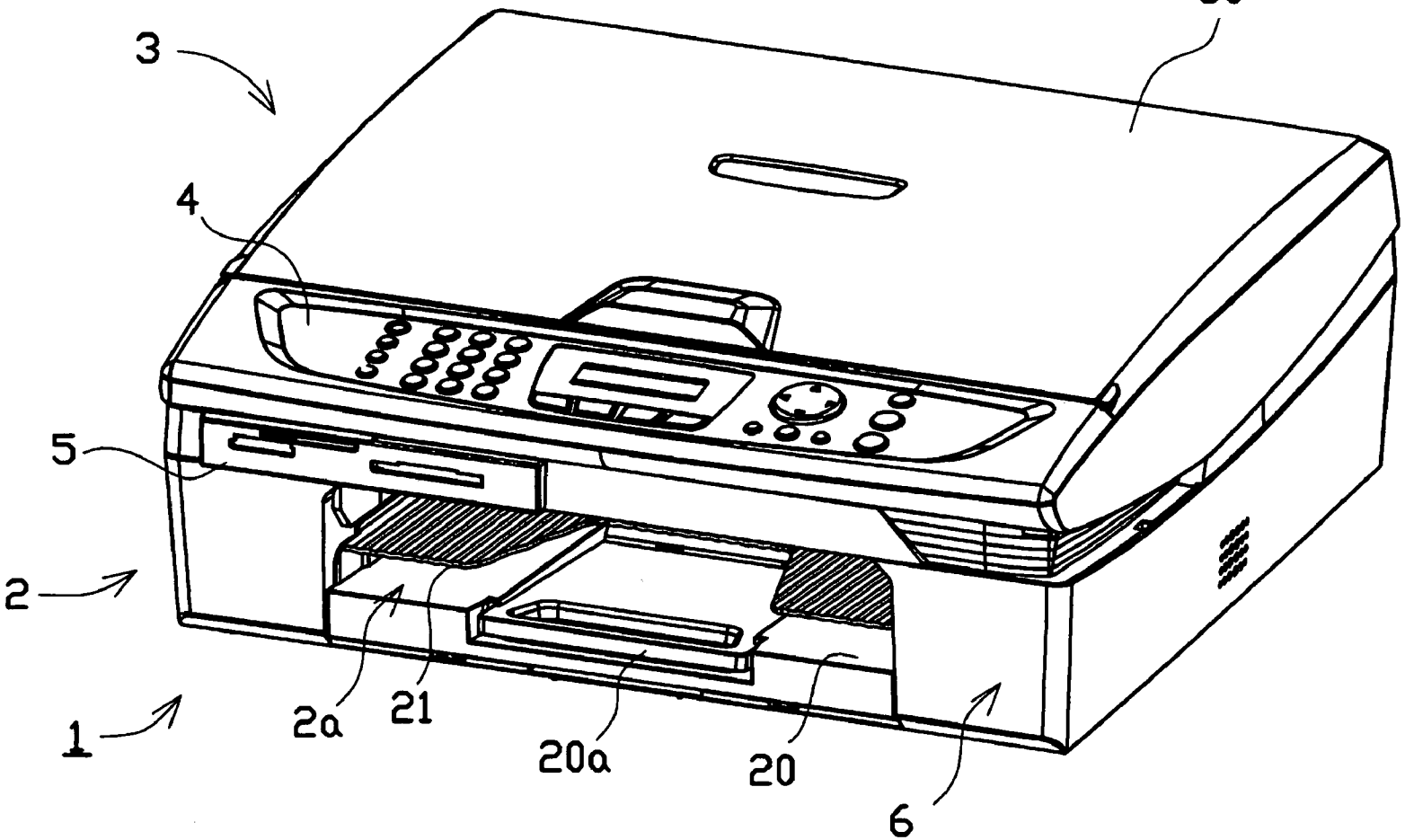
FIG. 1 is a perspective view showing an appearance configuration of a combined machine as an embodiment of an ink jet recording apparatus according to the present invention.
Figure 2:
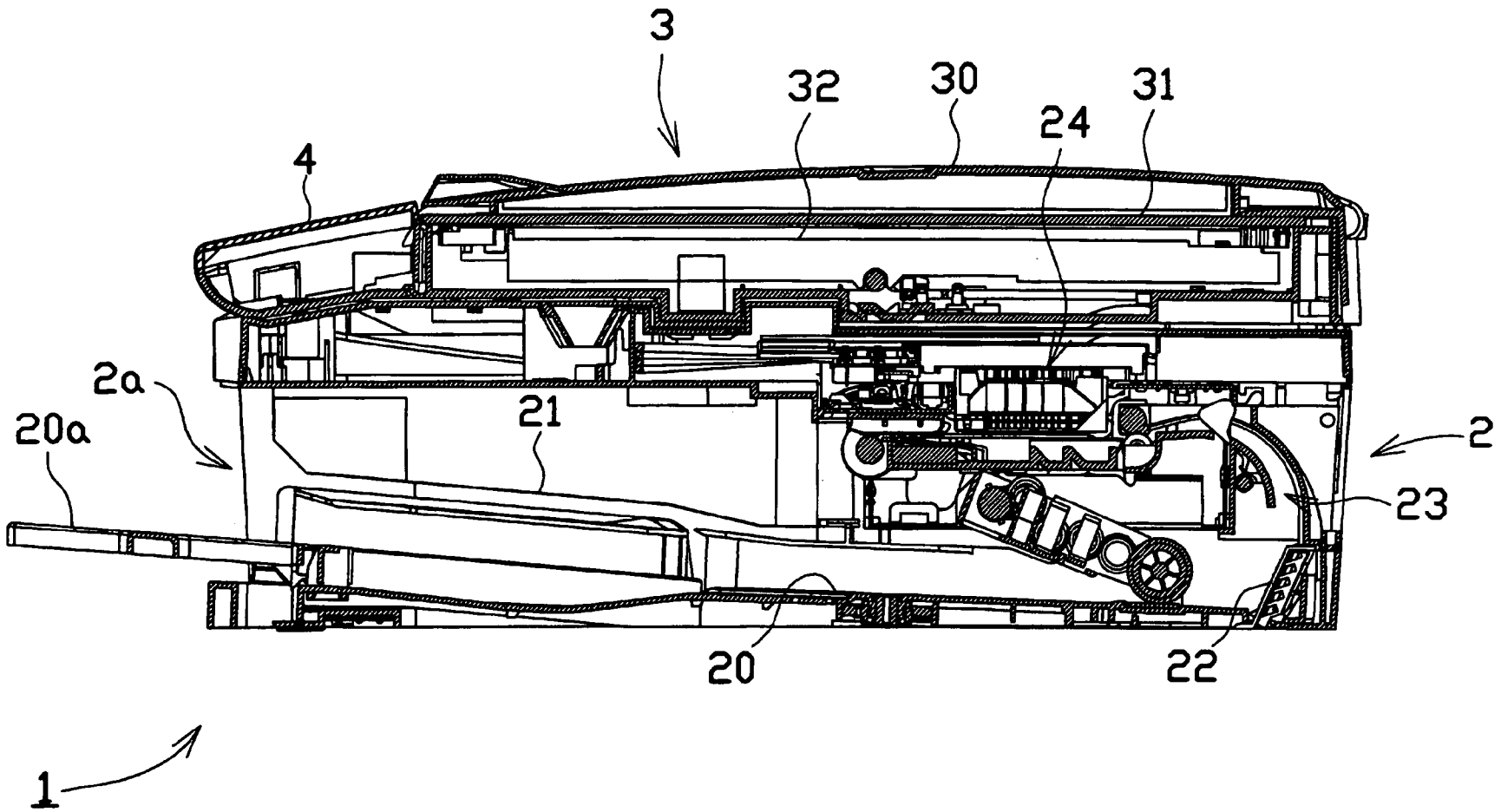
FIG. 2 is a longitudinal sectional view showing an internal configuration of a combined machine as an embodiment of an ink jet recording apparatus according to the present invention.

FIG. 1 is a perspective view showing an appearance configuration of MFD (Multi Function Device) as an embodiment of an ink jet recording apparatus according to the present invention. FIG. 2 is a longitudinal sectional view showing an internal configuration of the MFD as an embodiment of the ink jet recording apparatus according to the present invention. An ink feeding apparatus according to the present invention is built in the MFD shown in FIG. 1 and FIG. 2.

MFD 1 integrally comprises a printer unit 2 at a lower portion and a scanner unit 3 at an upper portion, and has a printer function, a scanner function, a copy function, and a facsimile function. The printer unit 2 realizing the printer function of the MFD 1 corresponds to an ink jet recording apparatus according to the present invention, and the remaining functions other than the printer function are optional functions. Therefore, the ink jet recording apparatus according to the present invention may be a single-functional printer including no scanner unit 3 and thus having neither scanner function nor copy function. The ink feeding apparatus according to the present invention is built in the printer unit 2 as an ink feeding mechanism 7, as described below.

For embodying the ink jet recording apparatus according to the present invention as an MFD, the recording apparatus may be a compact apparatus such as the MFD 1 shown in the present embodiment or a relatively large apparatus including a plurality of paper feeding cassettes and an automatic document feeder (ADF) and the like. The MFD 1 is mainly connected with a computer (external information device) (not shown), and records an image or a document on a recording paper based on print data including image data and/or document data sent from the computer. However, when connected with an external device such as a digital camera, the MFD 1 can also record on a recording paper image data outputted from the digital camera, and when any type of recording medium such as a memory card is loaded, the MFD 1 can also record on a recording paper image data and the like recorded in the loaded recording medium. A configuration of the MFD 1 described below is an example of the ink jet recording apparatus according to the present invention, thus of course the configuration can be suitably modified without departing from the technical scope of the present invention.

As shown in FIG. 1, the MFD 1 has an outer shape of almost broad and thin rectangular parallelepiped whose width and depth are greater than height. The printer unit 2 is built in a lower half portion of the MFD 1. The printer unit 2 has an opening 2*a* formed on a front face of the MFD 1, and a paper feeding tray 20 and a paper discharging tray 21 are installed on two stages composed of upper and lower stages (the paper feeding tray 20 on the bottom side) so that parts thereof are exposed from the opening 2*a*. The paper feeding tray 20 is provided for storing recording papers serving as a recording media and can store various sizes of recording papers including B5 size and postcard size equal to or smaller than A4 size. As shown in FIG. 2, the tray surface of the paper feeding tray 20 can be increased by drawing out a slide tray 20*a* as necessary. A recording paper stored in the paper feeding tray 20 is fed into the printer unit 2 and a desired image is recorded on the recording paper before being discharged onto the paper discharging tray 21.

The scanner unit 3 as a so-called flatbed scanner is built in an upper half portion of the MFD 1. As shown in FIG. 1 and FIG. 2, a platen glass 31 and an image sensor 32 are provided at a lower side of an original cover 30 provided freely openable and closable as a top plate of the MFD 1. The platen glass 31 is provided for placing an original thereon and reading an image of the original. Below the platen glass 31, an image sensor 32 whose main scanning direction is the same as a depth direction of the MFD 1 is provided so that the image sensor 32 can scan in a width direction (sub-scanning direction) of the MFD 1.

An operation panel 4 for operating the printer unit 2 and scanner unit 3 is provided at the upper portion of the front face of the MFD 1. The operation panel 4 has various types of operational buttons, a liquid crystal display unit, and so forth. The MFD 1 operates according to operation instructions from the operation panel 4 and, when connected with the computer, also operates according to instructions transmitted from the computer via a printer driver or a scanner driver. A slot unit 5 into which various types of small-size memory cards, which are recording media, can be loaded is provided in an upper left corner at the front face of the MFD 1. By operating the operation panel 4, a user can make the MFD 1 read out image data recorded in a small-size memory card loaded into the slot unit 5, display information about the readout image data on the liquid crystal display unit of the operation panel 4, and record (printout) any image on a recording paper by the printer unit 2 after selecting the image based on the information about the image data displayed on the liquid crystal display unit.

The internal configuration of the MFD 1 and particularly the configuration of the printer unit 2 will be described below with reference to FIG. 2 through FIG. 10.

As shown in FIG. 2, a tilted separating plate 22 for separating and guiding upward a recording paper placed on the paper feeding tray 20 is disposed in an inner portion of the paper feeding tray 20 provided at a bottom of the MFD 1. One end of a conveying path 23 is located above the tilted separating plate 22. The conveying path 23 directed from a rear side to a front side of the MFD 1 by further bending toward the front side after being directed upward from the one end of the tilted separating plate 22 side, and passes through an image recording unit 24 to be connected with the paper discharging tray 21 at the other end thereof. Therefore, a recording paper stored in the paper feeding tray 20 is guided upward from below along the conveying path 23 while making a U-turn in the inner portion of the printer unit 2 to reach the image recording unit 24, and after an image is recorded by the image recording unit 24, the recording paper is discharged onto the paper discharging tray 21.

Figure 3:
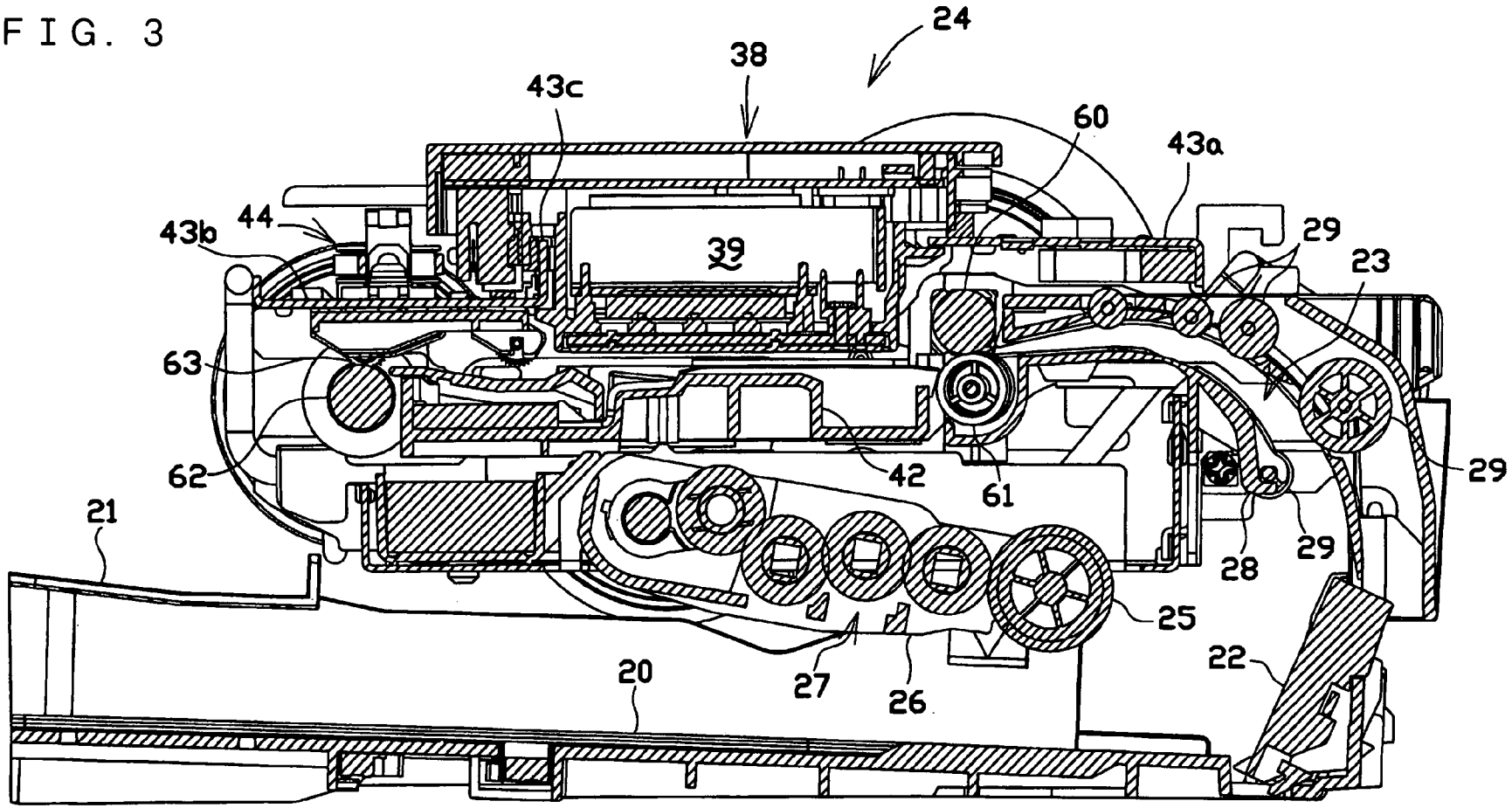
FIG. 3 is an enlarged sectional view showing an essential configuration of a printer unit as an ink jet recording apparatus according to the present invention.

FIG. 3 is an enlarged sectional view showing an essential configuration of the printer unit as an ink jet recording apparatus according to the present invention.

As shown in FIG. 3, a paper feeding roller 25 for supplying the recording papers stacked on the paper feeding tray 20 to the conveying path 23 after separating one by one is provided above the paper feeding tray 20. The paper feeding roller 25 is pivotally supported at a tip portion of a paper feeding arm 26 swinging upward and downward so as to enable attachment to and detachment from the paper feeding tray 20. The paper feeding roller 25 rotates with transmission of driving force of an LF motor 71 (See FIG. 8) via a drive transmission mechanism 27 in which a plurality of gears intermesh.

The paper feeding arm 26 is disposed at a tip portion side swingably in the upward and downward direction with a base end side as a rotation axis. As shown in figure, in a standby state, a tip portion of the paper feeding arm 26 is being lifted by a paper feeding clutch, spring, and the like (not shown) and is swung downward when feeding a recording paper. When the tip portion of the paper feeding arm 26 is swung downward, the paper feeding roller 25 pivotally supported at the tip portion thereof is brought into pressure contact with a surface of a uppermost-layer recording paper on the paper feeding tray 20. When the paper feeding roller 25 rotates in this state, the uppermost-layer recording paper is sent out to the tilted separating plate 22 by frictional force between a roller surface of the paper feeding roller 25 and the recording paper. The recording paper is guided upward when a front end thereof comes into contact with the tilted separating plate 22 and sent out into the conveying path 23. When the uppermost-layer recording paper is sent out by the paper feeding roller 25 as described above, a recording paper just below may also be sent out by friction and/or electrostatic force with the uppermost-layer recording paper. However, by contacting with the tilted separating plate 22, such a recording paper is prevented from being sent out into the conveying path 23.

The conveying path 23 is configured with an outer guide surface and an inner guide surface facing each other at a predetermined interval except portion where the image recording unit 24 and the like are disposed. For example, the conveying path 23 on the rear side of the MFD 1 is configured with an outer guide surface integrally formed with a frame of the MFD 1 and an inner guide surface of which a guide member 28 is fixed within the frame. In a particularly bent portion of the conveying path 23, a plurality of conveying rollers 29 are freely rotatably provided with a cross direction of the conveying path 23 as an axis direction so as to expose the roller surfaces to the outer guide surface or inner guide surface. These conveying rollers 29 smoothly convey the recording papers in contact with the guide surface in a bent portion of the conveying path 23.

As shown FIG. 3, the image recording unit 24 is provided in a portion near the paper discharging tray 21 of the conveying path 23. The image recording unit 24 includes a scanning carriage 38 mounting an ink jet recording head 39. The scanning carriage 38 reciprocates in the main scanning direction with the ink jet recording head 39 being mounted. Inside the MFD 1, ink tanks 40 are provided independently of the ink jet recording head 39 (See FIG. 5). The ink jet recording head 39 jets, as fine ink droplets, ink of the respective colors of cyan (C), magenta (M), yellow (Y), and black (Bk) supplied through ink tubes 41C, 41M, 41Y, and 41K respectively from ink tanks 40C, 40M, 40Y, and 40K of the respective colors. By carrying out scanning of the scanning carriage 38 having the ink jet recording head 39 described above, an image is recorded on a recording paper being conveyed on a platen 42. Hereafter, in a case where there is no need to differentiate color of ink tank or ink tube, respective reference numerals will be denoted simply as 40 or 41.

Figure 4:
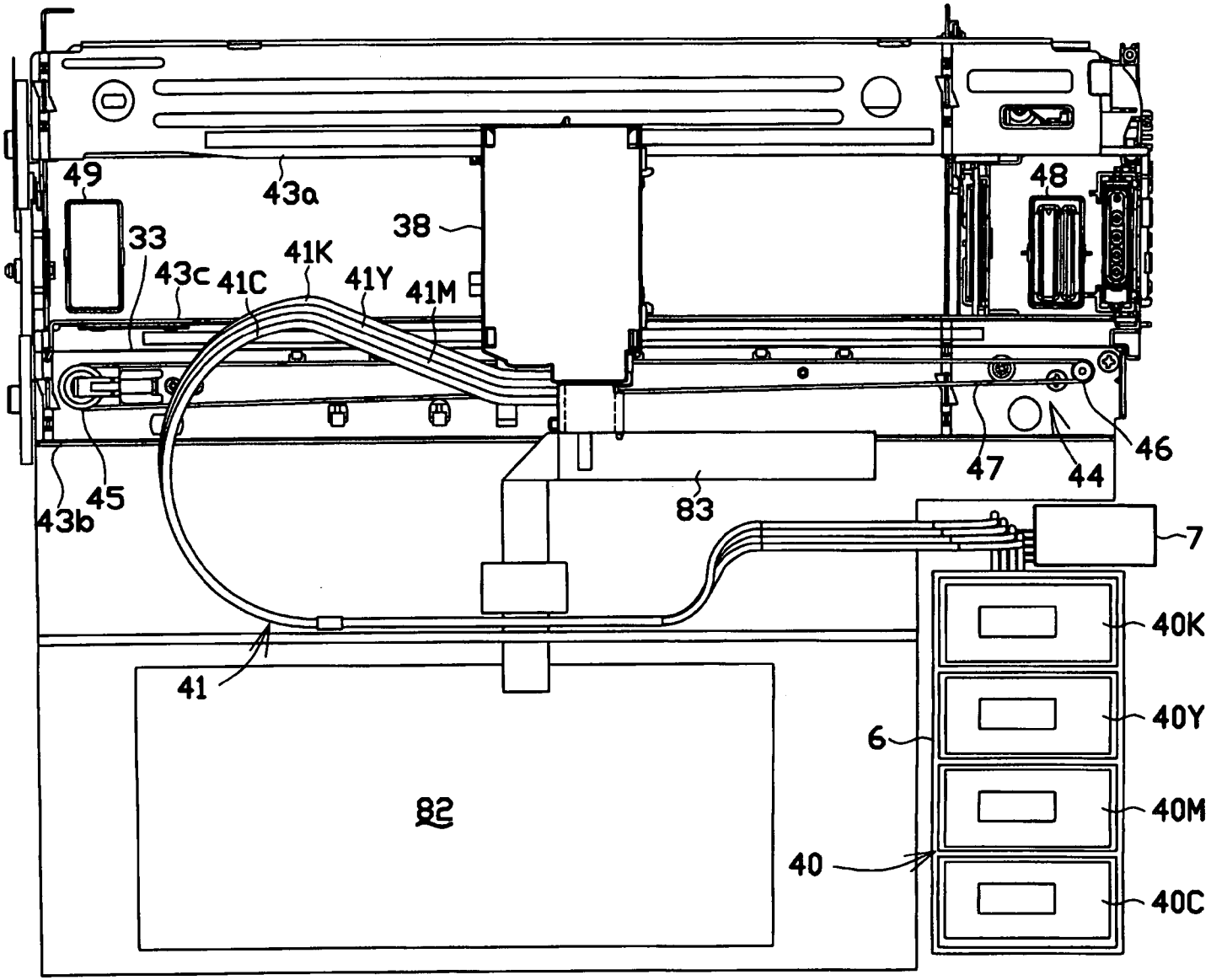
FIG. 4 is an enlarged plan view showing an essential configuration of a printer unit as an ink jet recording apparatus according to the present invention.

FIG. 4 is an enlarged plan view showing the essential configuration of a printer unit as an ink jet recording apparatus according to the present invention.

More particularly, as shown in FIG. 4, above the conveying path 23, a pair of guide rails 43*a* and 43*b* are installed in the cross direction of the conveying path 23 at predetermined intervals along a conveying direction of the recording papers. A scanning carriage 38 is provided in a slidable state being guided by the guide rails 43*a* and 43*b* while straddling the guide rails 43*a* and 43*b*. The guide rail 43*a* disposed upstream side of the conveying direction of the recording papers is longer in the cross direction of the conveying path 23 than a scan width of the scanning carriage 38 and is a tabular member parallel to a conveying path surface. A tabular upper surface of the guide rail 43*a* freely slidably carries and supports an upstream side end of the scanning carriage 38.

The guide rail 43*b* disposed downstream side of the conveying direction of the recording papers, on the other hand, is approximately as long as the above guide rail 43*a* in the cross direction of the conveying path 23 and is a tabular member parallel to the conveying path surface. However, an edge portion 43*c* is formed in the cross direction of the conveying path 23, or more specifically, parallel to a direction perpendicular to the conveying direction of the recording papers, by bending an upstream side edge portion in the conveying direction of the recording papers of the guide rail 43*b* upward approximately at right angles. A downstream side edge portion of the scanning carriage 38 is freely slidably carried and supported by the upper surface of a tabular portion of the guide rail 43*b* and holds both sides of the edge portion 43*c* by rollers (not shown) or the like. Therefore, the scanning carriage 38 straddles the guide rails 43*a* and 43*b* to be freely slidably carried and supported thereon, and at the same time reciprocates in the cross direction of the conveying path 23 being guided by the edge portion 43*c* of the guide rail 43*b*. Appropriate slidable members are provided for reducing friction in areas where the scanning carriage 38 comes into contact with the upper surfaces of the guide rails 43*a* and 43*b*.

As shown in FIG. 4, a belt driving mechanism 44 is disposed on the upper surface of the tabular portion of the guide rail 43*b*. The belt driving mechanism 44 is configured by stretching a timing belt 47 made by endlessly loop-connecting a belt (cogged belt) with cogs inside between a driven pulley 45 and a driving pulley 46 provided respectively near both ends in the cross direction of the conveying path 23. Driving force is inputted from a CR motor 73 (See FIG. 8) to an axis of the driving pulley 46. This force rotates the driving pulley 46 and, as a result, the timing belt 47 carries out circular motion. The timing belt 47 needs not be configured as an endless loop as described above. For example, the timing belt 47 may be configured by fixing both ends of a limited-length belt to the scanning carriage 38.

The scanning carriage 38 is fixed to one position of the endless loop-shaped timing belt 47 as described above. Therefore, when the timing belt 47 carries out circular motion, the scanning carriage 38 reciprocates on the guide rails 43*a* and 43*b* guided by the edge portion 43*c*. Since the ink jet recording head 39 is mounted on the scanning carriage 38, the ink jet recording head 39 can reciprocate in the cross direction of the conveying path 23 as the main scanning direction thereof. An encoder strip 33 of a linear encoder 77 (See FIG. 8) is disposed along the edge portion 43*c* of the guide rail 43*b*. Reciprocating motion of the scanning carriage 38 is controlled based on a detected signal obtained as a result of detection of the encoder strip 33 by the linear encoder 77 using, for example, a photo interrupter.

As shown in FIG. 3, at a lower side of the conveying path 23, a platen 42 is disposed facing the ink jet recording head 39. The platen 42 is disposed in a central portion of a path through which the recording papers within a range of the reciprocating motion of the scanning carriage 38 pass. The platen 42 has a width sufficiently larger than a maximum width of the recording papers that can be conveyed by the conveying path 23. Therefore, both ends of the recording papers always pass on the platen 42, in other words, without being stuck out of the platen 42.

As shown in FIG. 4, a cap 48 is disposed in a range where no recording paper passes, that is, in one end portion out of an image recording range by the ink jet recording head 39. The cap 48 is provided to cover ink outlets 53 for the purpose of preventing the ink outlets 53 of the ink jet recording head 39 from being dried. When the MFD 1 is transported or is not used, the scanning carriage 38 is moved so that the ink jet recording head 39 is positioned above the cap 48. Then, by moving the cap 48 upward in this state, the ink outlets 53 provided at a lower surface of the ink jet recording head 39 is tightly covered.

A waste ink tray 49 for receiving vain ink jetting from the ink jet recording head 39 is provided in another end portion out of the image recording range, though within the range of the reciprocating motion of the scanning carriage 38. The waste ink tray 49 receives ink discharged when removing bubbles or mixed color ink by flushing or the like. Inside the waste ink tray 49, a pad for absorbing ink is laid.

The ink tanks 40 are, as shown in FIG. 1 and FIG. 4, mounted in a cartridge mounting unit 6 provided in a housing located in a left portion (right side in FIG. 1) of the front side of the printer unit 2. As shown in FIG. 4, the cartridge mounting unit 6 is arranged in the apparatus separately from the scanning carriage 38 having the ink jet recording head 39. For this reason, ink is supplied to the scanning carriage 38 from the ink tanks 40 mounted in the cartridge mounting unit 6 through the ink tubes 41.

The ink tanks 40 includes four ink tanks 40C, 40M, 40Y, and 40K storing each of colors cyan (C), magenta (M), yellow (Y), and black (Bk). Each of the ink tanks 40C, 40M, 40Y, and 40K is mounted in a predetermined position in the cartridge mounting unit 6 provided in the apparatus housing. Since each of the ink tanks 40C, 40M, 40Y, and 40K has the same configuration except color of stored ink, the ink tank 40C for cyan will be taken below as an example for describing the ink tank in detail.

Figure 5:
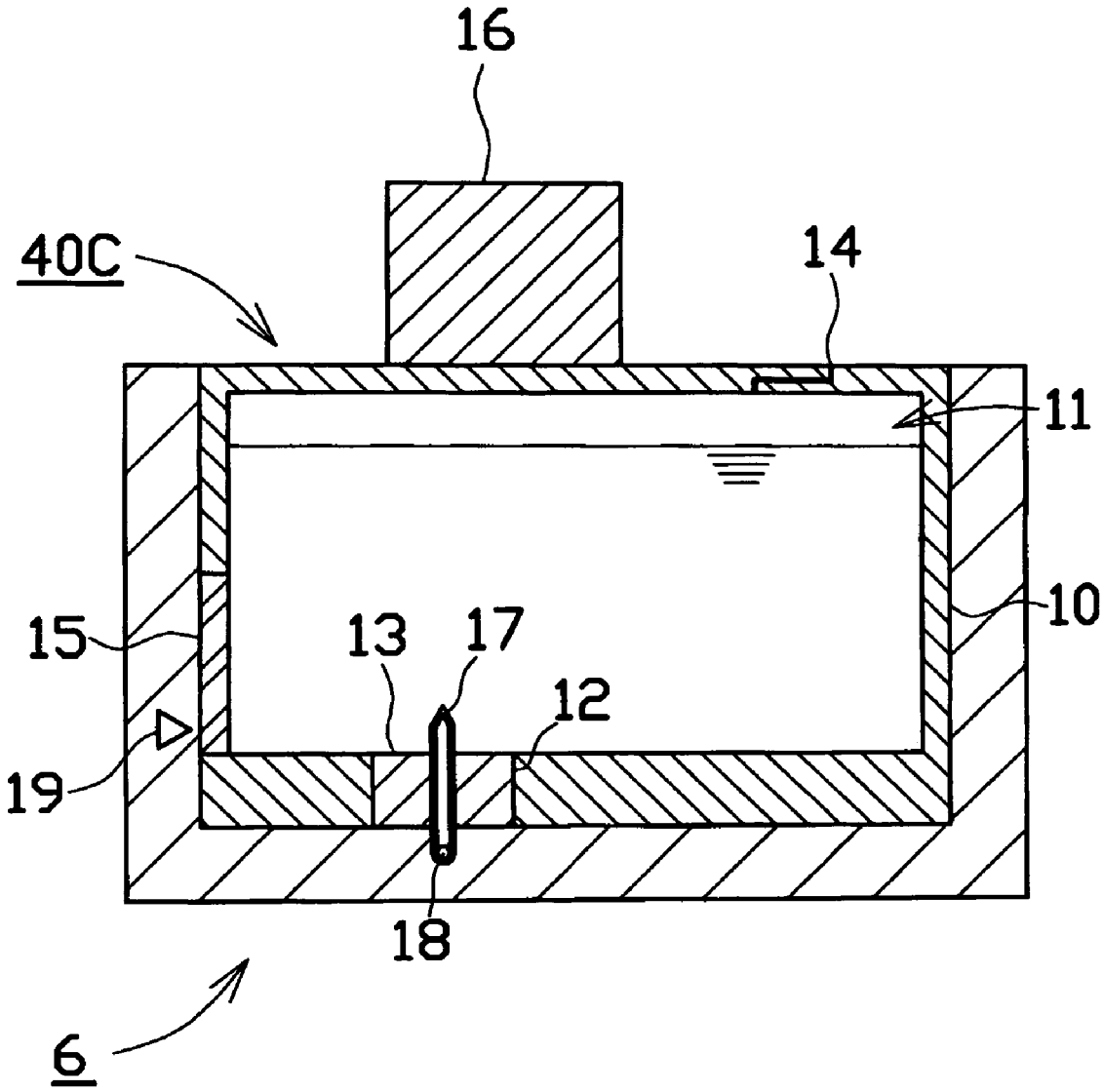
FIG. 5 is a sectional view showing an outline configuration of an ink tank and a cartridge mounting unit in an ink jet recording apparatus according to the present invention.

FIG. 5 is a sectional view showing an outline configuration of an ink tank (ink tank 40C for cyan) and a cartridge mounting unit of an ink jet recording apparatus according to the present invention.

As shown in FIG. 5, the ink tank 40C is a cartridge type attachable to and detachable from above the cartridge mounting unit 6, and is filled with cyan ink in an approximately rectangular parallelepiped-shaped synthetic-resin housing 10. Internal space of the housing 10 is used as an ink chamber 11 for storing cyan ink. An ink supply port 12 for supplying cyan ink stored in the ink chamber 11 to an outside is formed by penetrating a bottom of the housing 10.

The ink supply port 12 is sealed by a seal member 13. Therefore, in a state where the ink tank 40C is not attached to the cartridge mounting unit 6, cyan ink in the ink chamber 11 will not flow through the ink supply port 12. As the seal member 13, as will be described later, an elastic member such as silicone rubber, which can be pierced by an ink needle 17, but after the ink needle 17 is removed, a pierced trace is naturally sealed, is used.

On the upper surface of the housing 10, a labyrinth-shaped vent 14 is formed. The ink chamber 11 is open to air through the vent 14 without flowing out of the cyan ink in the ink chamber 11.

A translucent window 15 is provided near a lower end of one side of the housing 10. It is possible to check whether there is cyan ink in the ink chamber 11 through this window 15. More specifically, as will be described later, an amount of cyan ink in the ink chamber 11 is detected by an optical sensor through the window 15.

A handle 16 is provided projecting upward from the upper surface of the housing 10. The handle 16 serves as a grip for a user when attaching the ink tank 40C to and detaching the ink tank 40C from the cartridge mounting unit 6. Particularly, the handle 16 is useful when a user detaches the ink tank 40C from the cartridge mounting unit 6 by pulling it out upward.

The cartridge mounting unit 6 is configured capable of containing each of the aforementioned ink tanks 40 and as a container like shape having an opening on the upper surface thereof. For example, as shown in FIG. 5, the ink tank 40C is contained in the cartridge mounting unit 6 by fitting into it. Then, from an attached state shown in FIG. 5, for example, when a user lifts up the ink tank 40C by holding the handle 16, the ink tank 40C is detached from the cartridge mounting unit 6. In this way, the cartridge mounting unit 6 can held each ink tank 40 attachable and detachable.

The ink needle 17 whose tip portion is projecting upward is provided on an inner surface of the bottom of the cartridge mounting unit 6. A position where the ink needle 17 is provided in the cartridge mounting unit 6 corresponds to a position of the seal member 13 for sealing the ink supply port 12 when the ink tank 40C is attached to the cartridge mounting unit 6. Therefore, as shown in FIG. 5, when the ink tank 40C is attached to the cartridge mounting unit 6, the tip portion of the ink needle 17 penetrates the seal member 13 into the ink chamber 11. The ink needle 17 is a hollow needle and a hole communicating to the outside is bored near the tip portion thereof. Thus, ink in the ink chamber 11 flows into the ink needle 17 from the hole near the tip portion of the ink needle 17. A base portion of the ink needle 17 is communicated to a flow path 18 formed in the horizontal direction on the bottom of the cartridge mounting unit 6. Moreover, though not shown, the flow path 18 is communicated with the ink tube 41. Therefore, the ink in the ink chamber 11 is led out to the ink tank 40 through the ink needle 17 via the flow path 18 and ink tube 41.

Also, an ink sensor 19 is provided on a side wall of the cartridge mounting unit 6. The ink sensor 19 is arranged in a position corresponding to the windows 15 of each of the ink tanks 40C, 40M, 40Y, and 40K on a side wall of the cartridge mounting unit 6 corresponding to a position near the bottom of each of the ink chambers 11. The ink sensor 19 is an optical sensor and can detect whether there is ink in the ink chamber 11 based on a difference in reflected light amount corresponding to presence/absence of ink in the ink chamber 11.

This embodiment is described by taking as an example the MFD 1 for recording images using four colors of ink. However, the number of ink colors needs not be specifically limited in an ink jet recording apparatus according to the present invention. For example, to record an image using six or eight colors of ink, an ink tank 40 may be provided in accordance with the number of ink colors used. However, it goes without saying that the cartridge mounting unit 6 must have a size corresponding to the number of ink tanks and the numbers of the ink needles 17, flow paths 18, and ink sensors 19 must correspond to the number of ink tanks.

As shown in FIG. 4, ink of each color is supplied to the ink jet recording head 39 from each of the ink tanks 40C, 40M, 40Y, and 40K attached to the cartridge mounting unit 6 through the independent ink tube 41 for each color. Each of the ink tubes 41C, 41M, 41Y, and 41K is a synthetic resin tube and has flexibility to flex following scanning of the scanning carriage 38, or more specifically, following movement of the scanning carriage 38.

Each flow path 18 provided for each ink tank 40 in the cartridge mounting unit 6 is connected to one end of each of the ink tubes 41C, 41M, 41Y, and 41K. The ink tube 41C corresponds to the ink tank 40C and is used for supplying ink of cyan (C). Similarly, the ink tubes 41M, 41Y, and 41K correspond to the ink tanks 40M, 40Y, and 40K respectively and supply the ink of magenta (M), yellow (Y), and black (Bk), respectively.

Each of the ink tubes 41C, 41M, 41Y, and 41K led from the cartridge mounting unit 6 is drawn close to a central position in the cross direction of the apparatus and fixed to an appropriate member (unmovable member) such as a body frame. Then, parts of each of the ink tubes 41C, 41M, 41Y, and 41K from this fixed position to the scanning carriage 38 are not fixed, for example, to a body frame and change posture following reciprocating motion of the scanning carriage 38. That is, as the scanning carriage 38 moves to one end (left side in FIG. 4) of the reciprocating motion direction, each of the ink tubes 41C, 41M, 41Y, and 41K moves in a moving direction of the scanning carriage 38 while flexing to decrease a flection radius of a U-shaped curved portion. As the scanning carriage 38 moves to another end (right side in FIG. 4) of the reciprocating motion direction, each of the ink tubes 41C, 41M, 41Y, and 41K moves in the moving direction of the scanning carriage 38 while flexing to increase the flection radius of the U-shaped curved portion.

Figure 6:
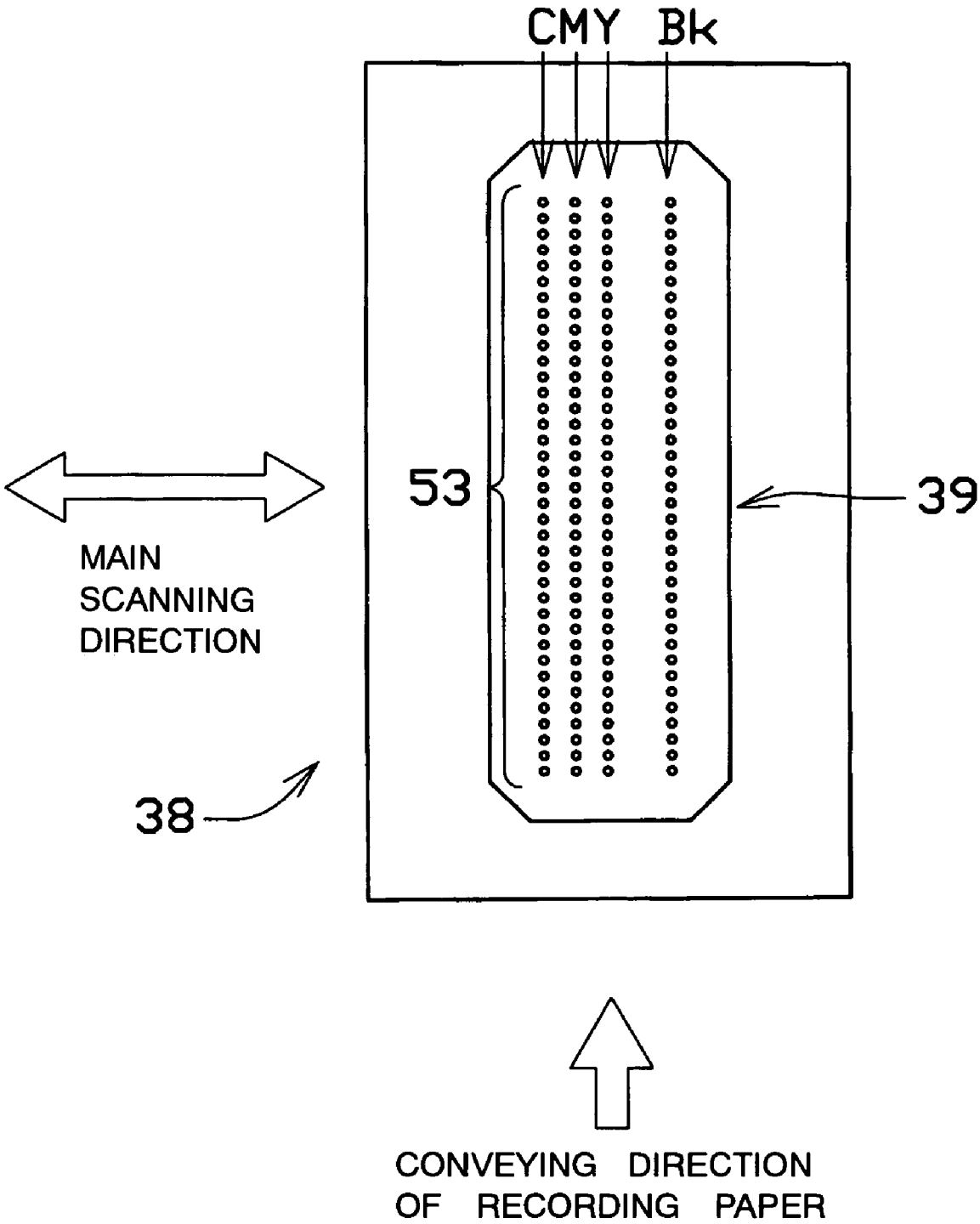
FIG. 6 is a bottom view from below of an ink jet recording head in an ink jet recording apparatus according to the present invention.

FIG. 6 is a bottom view from below of an ink jet recording head of an ink jet recording apparatus according to the present invention.

The ink jet recording head 39 has on the lower side thereof, as shown in FIG. 6, ink outlets 53 for each of the ink colors C, M, Y, and Bk provided in a row in the conveying direction (sub-scanning direction) of the recording papers. In FIG. 6, the upward and downward direction is the conveying direction of the recording papers and a horizontal direction is the main scanning direction of the scanning carriage 38. The ink outlets 53 for each of the ink colors C, M, Y, and Bk are arranged by color in the main scanning direction. A pitch and the number of ink outlets 53 of each color in the conveying direction of the recording papers are appropriately determined by considering resolutions of recorded images and the like. The row number of the ink outlets 53 is increased or decreased according to the number of kinds of color ink.

Figure 7:
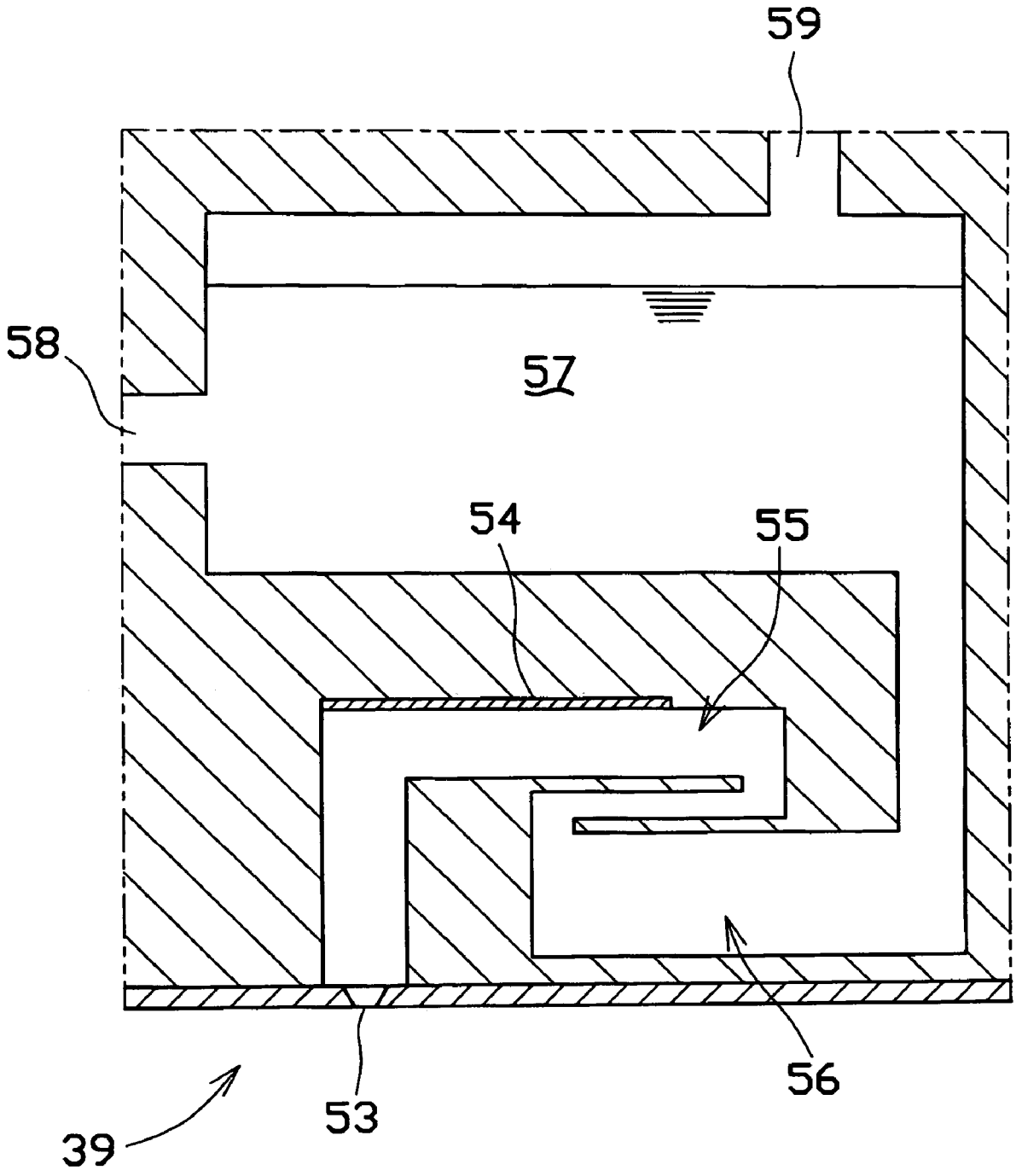
FIG. 7 is an enlarged sectional view showing an internal configuration of an ink jet recording head in an ink jet recording apparatus according to the present invention.

FIG. 7 is an enlarged sectional view showing an internal configuration of an ink jet recording head of an ink jet recording apparatus according to the present invention.

As shown in FIG. 7, a cavity 55 being provided with a piezoelectric element 54 is formed upstream side of the ink outlet 53 formed on the lower surface of the ink jet recording head 39. The piezoelectric element 54 reduces a volume of the cavity 55 by deforming when a predetermined voltage is applied. By reducing the volume of the cavity 55 in this way, ink in the cavity 55 is jetted as ink droplets from the ink outlet 53.

The cavity 55 is provided for each ink outlet 53 and a common manifold 56 is formed across a plurality of cavities 55 for each color of ink. A buffer tank 57 is provided above the manifold 56. The buffer tank 57 is provided for ink of each color of C, M, Y, and Bk. Ink of each color is supplied to each buffer tank 57 through an ink supply port 58 from the ink tank 40 via the ink tube 41. By storing ink once in the buffer tank 57, bubbles generated in the ink in the ink tube 41 and the like can be captured. As a result, bubbles are prevented from entering the cavity 55 and manifold 56. Bubbles captured in the buffer tank 57 are sucked and removed by a pump mechanism (not shown) from a bubble outlet 59. Ink supplied from the buffer tank 57 to the manifold 56 is distributed to each cavity 55 by the manifold 56.

As described above, an ink path is configured so that ink of each color supplied from the ink tank 40 through the ink tube 41 flows to the cavity 55 via the buffer tank 57 and manifold 56. Each of ink of the colors C, M, Y, and Bk supplied through the ink path is jetted to the recording paper as ink droplets from the ink outlets 53.

As shown in FIG. 4, the ink feeding mechanism 7, which is an ink feeding apparatus according to the present invention, is provided in a portion of the ink tube 41 near the cartridge mounting unit 6. The ink feeding mechanism 7 is communicated to the ink tubes 41C, 41M, 41Y, and 41K of each color and is provided for feeding ink of each color flowing through the respective ink tubes 41C, 41M, 41Y, and 41K to the ink jet recording head 39. Details of the configuration of the ink feeding mechanism 7 will be described later.

As shown in FIG. 3, upstream side of the image recording unit 24, a pair of a conveying roller 60 and a pushing roller 61 is provided for conveying the recording paper being conveyed along the conveying path 23 to the platen 42 by holding it therebetween. Downstream side of the image recording unit 24, on the other hand, a pair of a paper discharging roller 62 and a spur roller 63 is provided for conveying the recording paper after recorded by holding it therebetween. The conveying roller 60 and paper discharging roller 62 are intermittently driven at predetermined sub-scanning intervals by transmission of driving force from the LF motor 71. Therefore, the recording paper is conveyed intermittently at predetermined sub-scanning intervals. Rotation of the conveying roller 60 and that of the paper discharging roller 62 are synchronized, and a rotary encoder 76 is provided in the conveying roller 60 (See FIG. 8). Therefore, by detecting an encoder disk rotating together with the conveying roller 60 using a photo interrupter, rotation of the conveying roller 60 and that of paper discharging roller 62 are controlled.

The pushing roller 61, on the other hand, is freely rotatably provided in an energized state so as to press on the conveying roller 60 with predetermined pressing force. When a recording paper enters on between the conveying roller 60 and pushing roller 61, the pushing roller 61 retreats by a thickness of the recording paper to hold the recording paper between the conveying roller 60 and pushing roller 61. This ensures transmission of rotating force of the conveying roller 60 to the recording paper. The spur roller 63 is also provided in relation to the paper discharging roller 62 in the same manner. However, since the spur roller 63 is brought into pressure contact with the recording paper after recorded, the spur roller 63 has a spur-shaped contour roller surface to avoid degradation of images recorded on the recording papers.

Figure 8:
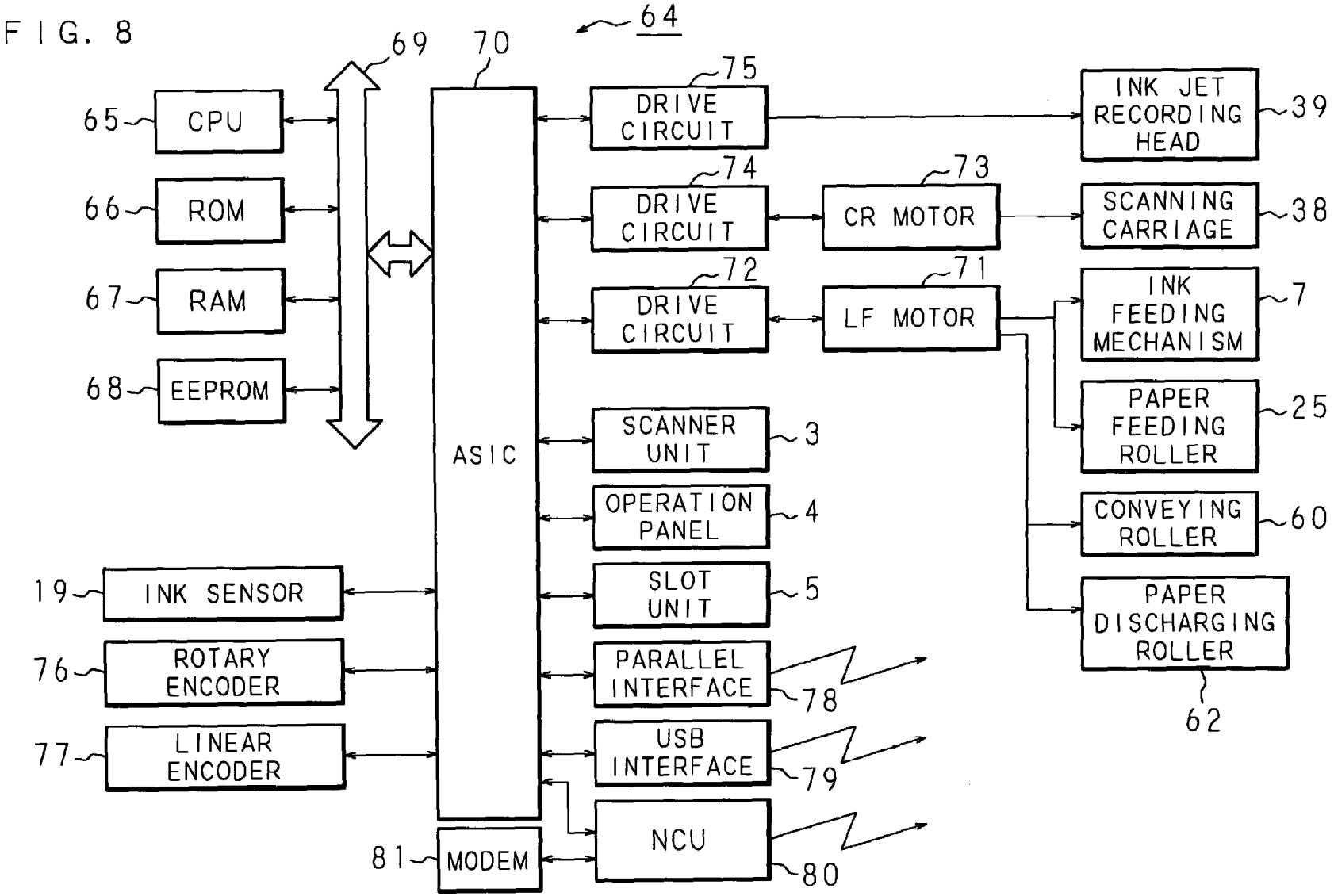
FIG. 8 is a block diagram illustrating a configuration of a control system of a combined machine as an embodiment of an ink jet recording apparatus according to the present invention.

FIG. 8 is a block diagram illustrating the configuration of a control system of the MFD 1 as an embodiment of an ink jet recording apparatus according to the present invention.

The control system includes various peripheral devices including a control unit 64 as a control center. The control unit 64 controls an overall operation of the MFD 1 including the printer unit 2 as well as the scanner unit 3. However, since the scanner unit 3 does not form the essential configuration element of the present invention, details thereof are omitted. As shown in FIG. 8, the control unit 64 is configured as a microcomputer essentially including CPU 65, ROM 66, RAM 67, and EEPROM 68 and is connected to an ASIC (Application Specific Integrated Circuit) 70 via a bus 69.

Programs and the like controlling various operations of the MFD 1 are stored in the ROM 66. The RAM 67 is used as a storage area or a working area for temporarily recording various kinds of data used when the CPU 65 executes programs stored in the ROM 66. In the EEPROM 68, settings, flags and the like to be maintained after power-off are stored.

The ASIC 70 generates a phase excitation signal and the like to be flowed to the LF (conveying) motor 71 according to an instruction from the CPU 65 and then provides the same to a drive circuit 72 of the LF motor 71. Rotation of the LF motor 71 is controlled by flowing a driving signal to the LF motor 71 via the drive circuit 72.

The drive circuit 72 drives the LF motor 71 connected with the aforementioned paper feeding roller 25, conveying roller 60, paper discharging roller 62, and ink feeding mechanism 7, they are described above. More specifically, the drive circuit 72 receives an output signal from the ASIC 70 and then generates an electric signal to rotate the LF motor 71. Rotation of the LF motor 71 upon receipt of the electric signal generated by the drive circuit 72 is transmitted as rotating force of the LF motor 71 to the paper feeding roller 25, conveying roller 60, paper discharging roller 62, and ink feeding mechanism 7 via a known drive mechanism including gears, driving shafts and the like. The ASIC 70 achieves desired operations of the ink feeding mechanism 7 by performing drive control of the LF motor 71 using a driving signal outputted from the ASIC 70 based on a control signal outputted from the CPU 65. Such drive control is performed independently for each ink tube 41.

Similarly, the ASIC 70 generates a phase excitation signal and the like to be flowed to a CR (carriage) motor 73 according to an instruction from the CPU 65. Rotation of the CR motor 73 is controlled by flowing to the CR motor 73 a signal generated by the drive circuit 72 provided to a drive circuit 74 of the CR motor 73 as a driving signal.

The drive circuit 74 drives the CR motor 73 connected with the scanning carriage 38. More specifically, the drive circuit 74 receives an output signal from the ASIC 70 and then generates an electric signal for rotating the CR motor 73. The CR motor 73 rotates upon receipt of the electric signal generated by the drive circuit 74 and the rotating force of the CR motor 73 is transmitted to the scanning carriage 38 via the belt driving mechanism 44 so that the scanning carriage 38 is scanned.

A drive circuit 75 selectively jets ink onto a recording paper from the ink jet recording head 39 in a predetermined timing. More specifically, the drive circuit 75 performs drive control of the ink jet recording head 39 by receiving an output signal generated in the ASIC 70 based on a drive control procedure outputted from the CPU 65.

The ink sensor 19 disposed in the cartridge mounting unit 6, the rotary encoder 76 for detecting rotation amount of the conveying roller 60, and the linear encoder 77 for detecting movement amount of the scanning carriage 38 are connected with the ASIC 70.

Also, the scanner unit 3, the operation panel 4 for receiving operation instructions of the MFD 1, the slot unit 5 into which various types of small-size memory cards are loaded, a parallel interface 78 for exchanging data with an external device such as a personal computer via a parallel or USB cable, and a USB interface 79 are connected with the ASIC 70. In addition, a NCU (Network Control Unit) 80 and a MODEM 80 which realizes a facsimile function are also connected with the ASIC 70.

Such control unit 64 as described above is configured by a main board 82 shown in FIG. 4. The signals for recording and the like is transmitted from the main board 82 to the ink jet recording head 39 via a flat cable 83. The flat cable 83 is a thin band-shaped cable made by sheathing a conductor for transmitting electric signals with a synthetic resin film such as a polyester film to insulate the conductor, and is electrically connected with the main board 82 and a control board (not shown) of the ink jet recording head 39. The flat cable 83 is led from the scanning carriage 38 in the direction of reciprocating motion and bent approximately U-shape into the upward and downward direction. The portion of this approximate U-shape is not fixed to any other member and changes posture following the reciprocating motion of the scanning carriage 38.

Figure 9:
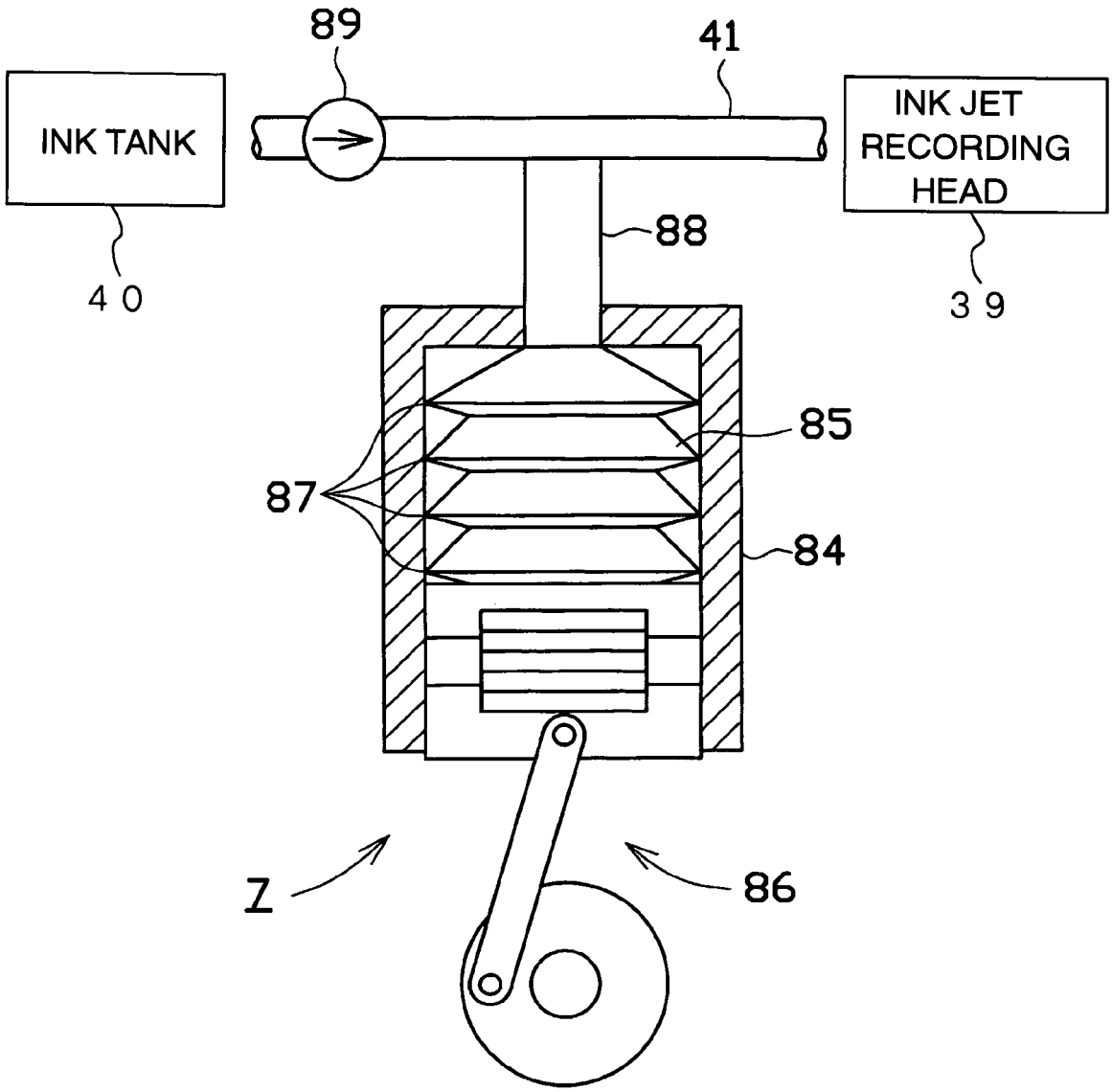
FIG. 9 is a schematic diagram showing an outline configuration of an ink feeding apparatus according to the present invention.

Details of the configuration of the ink feeding mechanism 7 will be described below. FIG. 9 is a schematic diagram showing the outline configuration of an ink feeding apparatus, that is, an ink feeding mechanism 7, according to the present invention.

The ink feeding mechanism 7 uses a so-called bellows pump. No ink color of the ink tube 41 is specified in FIG. 9 for convenience in description, but the similar ink feeding mechanism 7 is provided for each of the ink tubes 41C, 41M, 41Y, and 41K.

The ink feeding mechanism 7 is mainly configured by containing a bellows body 85 in a cylindrical pump case 84. The bellows body 85 is arranged, when the MFD 1 is placed on a horizontal plane, for enabling to expand and contract in the vertical direction in the pump case 84 by a piston/crank mechanism 86. The bellows body 85 is formed in an approximate cylindrical shape formed by successively building up in the vertical direction a ridge fold portion 87, whose side peripheral surface is projected outward in a direction (substantially horizontal direction) crossing the direction of expansion and contraction and bent, into bellows shape. A lower end portion of the bellows body 85 is connected with the piston/crank mechanism 86. Thereby, when the bellows body 85 is contracted vertically by the piston/crank mechanism 86, a bend angle of the ridge fold portion 87 changes. Since an internal volume of the bellows body 85 changes by the contracting of the bellows body 85, ink filled in the bellows body 85 goes out of and comes into a connection port 88 (connection portion).

The connection port 88 is connected to an upper end portion of the bellows body 85. The connection port 88 is connected to the ink tube 41 by penetrating the pump case 84. A nonreturn valve 89 is provided in the ink path on the ink tank 40 side from a connection portion between the connection port 88 and ink tube 41. Thus, ink flowing in the ink tube 41 can flow only from the ink tank 40 to the ink jet recording head 39.

Therefore, when the bellows body 85 is expanded and the internal volume thereof increases, ink flows into the bellows body 85 from the ink tube 41 through the connection port 88. When, on the other hand, the bellows body 85 is contracted and the internal volume thereof decreases, ink flows from the bellows body 85 into the ink tube 41 through the connection port 88. Since the nonreturn valve 89 is provided, as described above, on the ink tank 40 side of the ink tube 41, the ink flowing out from the bellows body 85 flows only to an ink jet recording head 39 side. By repeated expansion and contraction of the bellows body 85 as described above, ink is fed from the ink tank 40 to the ink jet recording head 39 side.

The above-described ink feeding, is performed during initial installation of ink or when bubbles need to be removed accompanying replacement of an ink tank 40, or the like. Bubbles may be generated for a variety of causes in the ink path from the ink tank 40 to the ink jet recording head 39. Once bubbles are generated for whatever reason, they could cause false-jetting of ink by the ink jet recording head 39. Therefore, it is all the more desirable to remove bubbles in situations that facilitate generation of bubbles such as when replacing the ink tank 40.

Removing bubbles are executed by moving the scanning carriage 38 above the waste ink tray 49 (See FIG. 4). After positioning the scanning carriage 38 above the waste ink tray 49, the piston/crank mechanism 86 operates by transmitting driving force of the LF motor 71 to the piston/crank mechanism 86 of the ink feeding mechanism 7. This leads to expansion and contraction of the bellows body 85 in the vertical direction and ink flows in and out through the connection port 88, as described above, feeding ink in the ink tube 41 to the ink jet recording head 39 side. Then, ink is discharged from the ink outlets 53 of the ink jet recording head 39 to the waste ink tray 49. Bubbles generated in the ink tube 41 flow together with ink to the ink jet recording head 39 side to be captured in the buffer tank 57 (See FIG. 7). In this way, bubbles generated in the ink tube 41 are removed.

Since such an ink feeding mechanism 7 is provided for each of the ink tubes 41C, 41M, 41Y, and 41K, only the ink feeding mechanism 7 corresponding to ink from which bubbles should be removed can be driven. Therefore, bubbles can be discharged only from the desired ink tube 41 without discharging ink from which no bubbles need to be removed. In addition, the LF motor 71 driving the piston/crank mechanism 86 of the ink feeding mechanism 7 needs not be provided for each ink feeding mechanism 7. For example, using a well known drive switching mechanism such as a clutch mechanism, driving force of the LF motor 71 needs to be selectively transmitted only to a desired piston/crank mechanism 86.

Figure 10:
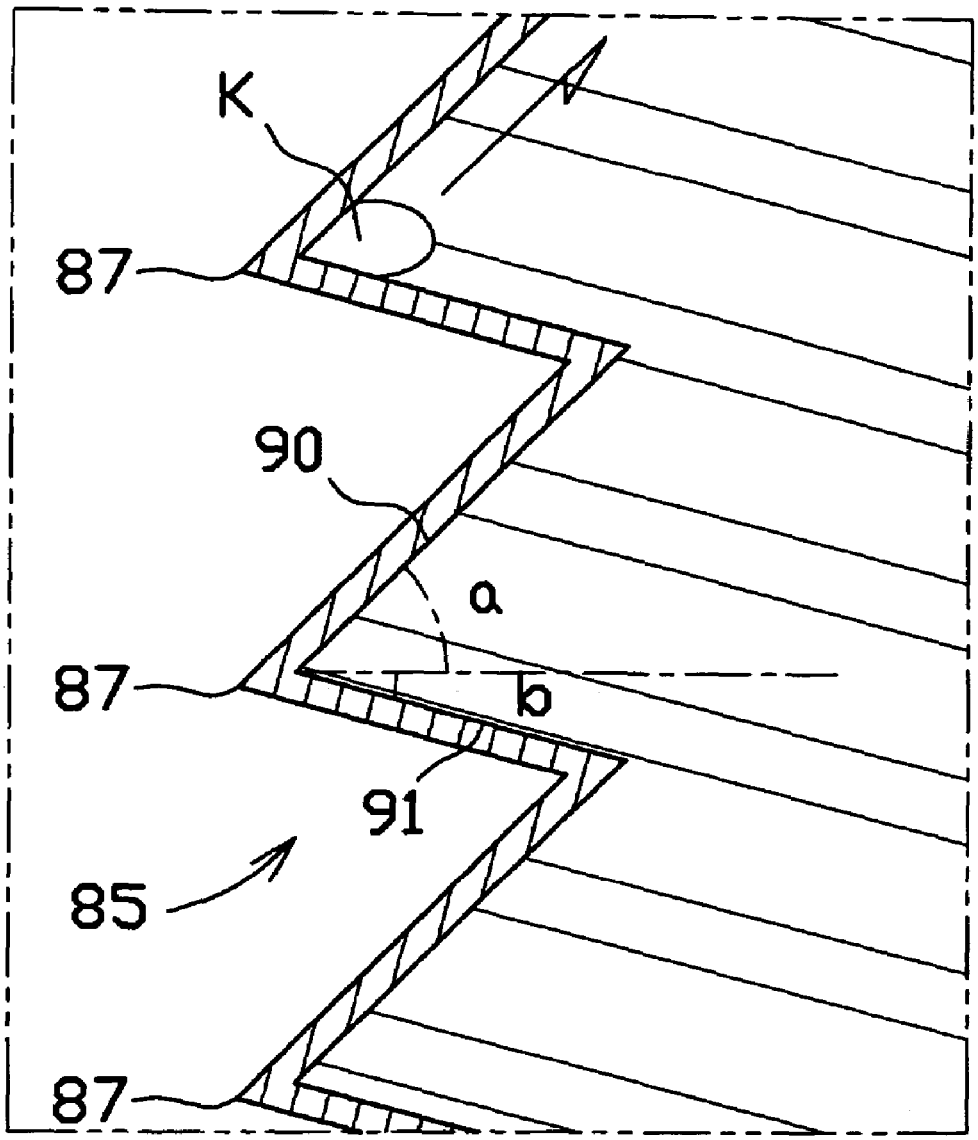
FIG. 10 is an enlarged sectional view showing a configuration of a ridge fold portion of a bellows body in an ink feeding mechanism of an ink jet recording apparatus according to the present invention.

FIG. 10 is an enlarged sectional view showing the configuration of a ridge fold portion of a bellows body of an ink feeding mechanism of an ink jet recording apparatus according to the present invention. It goes without saying that the bellows body 85 is connected to the ink tube 41 with the connection port 88 being directed upward. More specifically, under a state where the ink jet recording apparatus is placed on the horizontal surface, it is desirable that the direction of expansion and contraction of the bellows body 85 be in the vertical direction. The reason for this desirability is that, if the bellows body 85 is connected to the ink tube 41 with the connection port 88 being directed downward, bubbles would remain in an upper portion in the bellows body 85. That is, the bellows body 85 is connected to the ink tube 41 so as to cause ink flow upward from below.

As shown in FIG. 10, under a state where the ink jet recording apparatus is placed on the horizontal surface, an inside of the ridge fold portion 87, a tilt angle of an upper inclined plane 90 on an upper side from a bend corner with respect to the horizontal direction is made to be greater than a tilt angle of a lower inclined plane 91 on a lower side from the bend corner with respect to the horizontal direction. More specifically, as shown in FIG. 10, define the tilt angle formed upward by the upper inclined plane 90 with the horizontal direction as an angle a. Similarly, define the tilt angle formed downward by the lower inclined plane 91 with the horizontal direction as an angle b. Then, since the angle b is greater than the angle a as described above, a relation angle b<angle a holds.

The angles a and angle b can be set arbitrarily in the range of 0° to less than 90°. That is, any angle a and angle b can be set arbitrarily as long as the relation 0°≦angle b<angle a<90° holds. However, it is desirable that the angle a be in the range of 40° to 75°. When the angle a is too small, the upper inclined plane 90 would tilt so as to lay down on a horizontal side, making it difficult for bubbles to rise along the upper inclined plane 90. When, on the other hand, the angle a is too large, the upper inclined plane 90 would rise to a vertical side, reducing retractility of the bellows body 85. Considering these conditions, and a reason that the ink jet recording apparatus is not always placed on the horizontal surface, it would be appropriate to set the angle a in the range of 40° to 75°.

By the way, it is desirable that above mentioned values of the angle a and the angle b, and the relation between them are maintained in a case where the piston/crank mechanism 86 does not operate. More specifically, when stoppage position of the piston/crank mechanism 86 is uncertain, it is desirable that above mentioned values of the angle a and the angle b, and the relation between them are maintained in both cases where the bellows body 85 maximally contracts and where the bellows body 85 maximally expands. In this case, above mentioned values of the angle a and the angle b, and the relation between them are always maintained.

On the other hand, when stoppage position of the piston/crank mechanism 86 is constant, it is desirable that above mentioned values of the angle a and the angle b, and the relation between them are maintained at least in a case where the piston/crank mechanism 86 does not operate. In this case, above mentioned values of the angle a and the angle b, and the relation between them are surely realized at least a moment during expansion and contraction of the bellows body 85.

As shown in FIG. 10, bubbles K may be generated also in the bellows body 85 whose internal space is filled with ink. Bubbles K may be generated by a variety of causes. For example, there may be a case in which gas dissolved in ink appears as the bubbles K due to change of temperature, or a case in which air penetrates a side peripheral wall of the bellows body 85 from outside the bellows body 85 to reach the inside of the bellows body 85. When the bubbles K grow larger making the bubbles K a core thereof, ink flow in the ink tube 41 may be disturbed by the grown bubbles K flowing out to the ink tube 41. This could cause poor ink jetting from the ink jet recording head 39. Therefore, it is desirable that no bubbles exist in the bellows body 85. When the bubbles K are generated, it is desirable that they be discharged to the ink tube 41 to be captured by the buffer tank 57 before growing larger.

As shown in FIG. 10, it is empirically known that the bubbles K are more likely to be generated inside the bend corner of the ridge fold portion 87. Since, according to the present invention, as described above, inside of the ridge fold portion 87, an angle a formed upward by the upper inclined plane 90 with respect to the horizontal direction is made to be greater than an angle b formed downward by the lower inclined plane 91 with respect to the horizontal direction, the bubbles K generated in the ridge fold portion 87 are more likely to rise along the upper inclined plane 90. Therefore, the bubbles K are easily separated from the ridge fold portion 87 to be naturally discharged from the connection port 88 to the ink tube 41.

As described above, an ink feeding mechanism 7, which is an ink feeding apparatus according to the present invention, can reliably discharge the bubbles K existing in the bellows body 85 from the bellows body 85 to the ink tube 41 before the bubbles K grow larger. The bubbles K discharged to the ink tube 41 move to the ink jet recording head 39 side together with ink due, for example, to an image recording operation, and are captured at the buffer tank 57.

In aforementioned embodiments, in the ink feeding mechanism 7, the bellows body 85 is expanded and contracted by the piston/crank mechanism 86. However, a drive mechanism for expanding and contracting the bellows body 85 is not limited to the piston/crank mechanism 86, and it is needless to say that any other well known drive mechanisms of different types can be arbitrarily selected.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claim.

The invention claimed is:

1. An ink feeding apparatus comprising:
an ink tank in which ink is stored;
an image recording unit including an ink jet recording head for jetting the ink supplied from said ink tank as ink droplets;
an ink path enabling the ink to flow between said ink tank and said image recording unit; and
an ink feeding mechanism including a bellows pump connected midway of said ink path to make the ink flow; wherein
said ink flows in said bellows pump, and said bellows pump comprises:
a bellows body whose internal volume changes by expanding and contracting in an upward and downward direction; and
a connection portion provided above said bellows body to connect said bellows body and said ink path; and
wherein a ridge portion comprising a first inclined plane and a second inclined plane, wherein the first inclined plane is closer to the connection portion than the second inclined plane, and the first inclined plane has an internal angle $\alpha$ between an imaginary line extending in a direction perpendicular to the direction in which said bellows body expands and contracts, and the second inclined plane has an internal angle $\beta$ between the imaginary line and the second inclined plane of the connection portion, wherein angle $\alpha$ and angle $\beta$ are related such that $0° \leqq \text{angle } \beta < \text{angle } \alpha < 90°$; and
wherein said values of the angle $\alpha$ and the angle $\beta$, and the relation between them are maintained in both cases where said bellows body maximally contracts and where said bellows body maximally expands, or realized at least one time during an expansion and a contraction of said bellows body.

2. The ink feeding apparatus as set forth in claim 1, wherein
a plurality of said ink tanks, a plurality of said ink paths, and a plurality of said bellows pumps are provided respectively corresponding to a plurality of ink colors,
each said ink path can flow ink between each said ink tank and said image recording unit independently,
each said bellows pump can feed each ink flowing in each said ink path, respectively, and
each said bellows pump can independently be driven.

3. The ink feeding apparatus as set forth in claim 1, wherein said angle $\alpha$ is preferably in a range of 40° to 75°.

4. The ink feeding apparatus as set forth in claim 3, wherein said values of the angle $\alpha$ and the angle $\beta$, and the relation between them are maintained in both cases where said bellows body maximally contracts and where said bellows body maximally expands, or realized at least one time during an expansion and a contraction of said bellows body.

5. The ink feeding apparatus as set forth in claim 4, wherein
a plurality of said ink tanks, a plurality of said ink paths, and a plurality of said bellows pumps are provided respectively corresponding to a plurality of ink colors,
each said ink path can flow ink between each said ink tank and said image recording unit independently,
each said bellows pump can feed each ink flowing in each said ink path, respectively, and
each said bellows pump can independently be driven.

6. An ink jet recording apparatus being provided with an ink feeding apparatus,
said ink feeding apparatus comprising:
an ink tank in which ink is stored;
an image recording unit including an ink jet recording head for jetting the ink supplied from said ink tank as ink droplets;
an ink path enabling the ink to flow between said ink tank and said image recording unit; and
an ink feeding mechanism including a bellows pump connected midway of said ink path to make the ink flow; wherein
said ink flows in said bellows pump, and said bellows pump comprises:
a bellows body whose internal volume changes by expanding and contracting in an upward and downward direction; and
a connection portion provided above said bellows body to connect said bellows body and said ink path; and
wherein a ridge portion comprising a first inclined plane and a second inclined plane, wherein the first inclined plane is closer to the connection portion than the second inclined plane, and the first inclined plane has an internal angle $\alpha$ between an imaginary line extending in a direction perpendicular to the direction in which said bellows body expands and contracts and the second inclined plane has an internal angle $\beta$ between the imaginary line and the second inclined plane of the connection portion, wherein angle $\alpha$ and angle $\beta$ are related such that $0° \leqq \text{angle } \beta < \text{angle } \alpha < 90°$; and
wherein said values of the angle $\alpha$ and the angle $\beta$, and the relation between them are maintained in both cases where said bellows body maximally contracts and where said bellows body maximally expands, or realized at least one time during an expansion and a contraction of said bellows body.

7. The ink jet recording apparatus as set forth in claim 6, wherein
a plurality of said ink tanks, a plurality of said ink paths, and a plurality of said bellows pumps are provided respectively in said ink feeding apparatus corresponding to a plurality of ink colors,
each said ink path can flow ink between each said ink tank and said image recording unit independently,
each said bellows pump can feed each ink flowing in each said ink path, respectively, and
each said bellows pump can independently be driven.

8. The ink jet recording apparatus as set forth in claim 6, wherein said angle $\alpha$ is preferably in a range of 40° to 75°.

9. The ink jet recording apparatus as set forth in claim 8, wherein said values of the angle $\alpha$ and the angle $\beta$, and the relation between them are maintained in both cases where said bellows body maximally contracts and where said bellows body maximally expands, or realized at least one time during an expansion and a contraction of said bellows body.

10. The ink jet recording apparatus as set forth in claim 9, wherein a plurality of said ink tanks, a plurality of said ink paths, and a plurality of said bellows pumps are provided respectively in said ink feeding apparatus corresponding to a plurality of ink colors, each said ink path can flow ink between each said ink tank and said image recording unit independently, each said bellows pump can feed each ink flowing in each said ink path, respectively, and each said bellows pump can independently be driven.

* * * * *